US010183331B2

(12) United States Patent
Couret et al.

(10) Patent No.: US 10,183,331 B2
(45) Date of Patent: Jan. 22, 2019

(54) METHOD FOR MANUFACTURING A TITANIUM-ALUMINUM ALLOY PART

(71) Applicants: CENTRE NATIONAL DE LA RECHERCHE SCIENTIFIQUE—CNRS—, Paris (FR); ONERA (Office National d'Etudes et de Recherches Aérospatiales), Chatillon (FR)

(72) Inventors: Alain Couret, Saverdun (FR); Jean-Philippe Monchoux, Toulouse (FR); Marc Thomas, Le Plessis Robinson (FR); Thomas Voisin, Toulouse (FR)

(73) Assignees: CENTRE NATIONAL DE LA RECHERCHE SCIENTIFIQUE—CNRS—, Paris (FR); ONERA (OFFICE NATIONAL D'ETUDES ET DE RECHERCHES AÉROSPATIALES), Chatillon (FR)

( * ) Notice: Subject to any disclaimer, the term of this patent is extended or adjusted under 35 U.S.C. 154(b) by 388 days.

(21) Appl. No.: 14/897,877

(22) PCT Filed: Jun. 11, 2014

(86) PCT No.: PCT/FR2014/051419
§ 371 (c)(1),
(2) Date: Dec. 11, 2015

(87) PCT Pub. No.: WO2014/199082
PCT Pub. Date: Dec. 18, 2014

(65) Prior Publication Data

US 2016/0121400 A1 May 5, 2016

(30) Foreign Application Priority Data

Jun. 11, 2013 (FR) ..... 13 55393

(51) Int. Cl.
*B22F 3/00* (2006.01)
*B22F 3/14* (2006.01)
(Continued)

(52) U.S. Cl.
CPC ..... *B22F 3/14* (2013.01); *B22F 3/105* (2013.01); *B22F 5/008* (2013.01); *B22F 5/009* (2013.01);
(Continued)

(58) Field of Classification Search
CPC ..... B22F 3/14; B22F 3/105
(Continued)

(56) References Cited

U.S. PATENT DOCUMENTS 5,207,982 A 5/1993 Nazmy et al.
5,286,443 A 2/1994 Nazmy et al.
(Continued)

FOREIGN PATENT DOCUMENTS

JP H08092602 A 4/1996

OTHER PUBLICATIONS

Appel, F. et al., "Microstructure and deformation of two-phase γ-titanium aluminides," Materials Science and Engineering, R22, pp. 187-268, 1998.
(Continued)

*Primary Examiner* — Mark A Chapman
(74) *Attorney, Agent, or Firm* — Seed IP Law Group LLP

(57) ABSTRACT

A method manufactures a metal alloy part by spark plasma sintering. The method includes the simultaneous application, inside a die, of a uniaxial pressure and of an electric current to a powder component material that has the following composition: 42 to 49% aluminum, 0.05 to 1.5% boron, at least 0.2% of at least one element selected from tungsten, rhenium and zirconium, optionally 0 to 5% of one or more elements selected from chromium, niobium, molyb-
(Continued)

| Spectrum | Al | Ti | W |
|---|---|---|---|
| 1 | 44.93 | 52.89 | 2.18 |
| 2 | 45.08 | 52.64 | 2.27 |
| 3 | 44.98 | 52.78 | 2.24 |
| 4 | 45.08 | 53.00 | 1.92 |
| 5 | 45.47 | 52.48 | 2.05 |
| 6 | 45.57 | 52.29 | 2.14 |
| 7 | 45.86 | 52.00 | 2.14 |
| 8 | 45.64 | 52.40 | 1.96 |
| 9 | 44.29 | 53.52 | 2.19 |
| 10 | 44.54 | 53.15 | 2.31 |
| 11 | 44.22 | 53.72 | 2.06 |
| 12 | 43.81 | 53.67 | 2.53 |
| 13 | 44.58 | 53.23 | 2.19 |

| γ |
|---|
| β |
| Lam |

denum, silicon and carbon, the balance being titanium and the total of the elements without aluminum and titanium being between 0.25 and 12%.

12 Claims, 6 Drawing Sheets

(51) Int. Cl.

| | |
|---|---|
| ***B22F 3/105*** | (2006.01) |
| ***B22F 5/04*** | (2006.01) |
| ***C22C 1/04*** | (2006.01) |
| ***C22C 14/00*** | (2006.01) |
| ***C22F 1/18*** | (2006.01) |
| ***F01L 3/02*** | (2006.01) |
| ***F01D 5/28*** | (2006.01) |
| ***B22F 5/00*** | (2006.01) |

(52) U.S. Cl.
CPC ..... *B22F 5/04* (2013.01); *C22C 1/0458* (2013.01); *C22C 14/00* (2013.01); *C22F 1/183* (2013.01); *F01D 5/28* (2013.01); *F01D 5/288* (2013.01); *F01L 3/02* (2013.01); *B22F 2003/1051* (2013.01); *F01L 2103/00* (2013.01); *F05C 2201/021* (2013.01); *F05C 2201/025* (2013.01)

(58) Field of Classification Search
USPC ..... 419/48, 51
See application file for complete search history.

(56) References Cited

U.S. PATENT DOCUMENTS

| | | | |
|---|---|---|---|
| 5,397,533 | A | 3/1995 | Morikawa et al. |
| 5,846,345 | A | 12/1998 | Naka et al. |
| 2014/0014639 | A1 | 1/2014 | Couret et al. |

OTHER PUBLICATIONS

Paul, J.D.H. et al., "Strength Properties of a Precipitation Hardened High Niobium Containing Titanium Aluminide Alloy," Gamma Titanium Aluminides, TMS (The Minerals, Metals & Materials Society), pp. 403-408, 2003.

Couret, A. et al., "Microstructures and mechanical properties of TiAl alloys consolidated by spark plasma sintering," Intermetallics 16, pp. 1134-1141, 2008.

Molénat et al., "Application of Spark Plasma Sintering to Titanium Aluminide Alloys," *Advanced Engineering Materials 9*(8):667-669, 2007.

| Spectrum | Al | Ti | W |
|---|---|---|---|
| 1 | 44.93 | 52.89 | 2.18 |
| 2 | 45.08 | 52.64 | 2.27 |
| 3 | 44.98 | 52.78 | 2.24 |
| 4 | 45.08 | 53.00 | 1.92 |
| 5 | 45.47 | 52.48 | 2.05 |
| 6 | 45.57 | 52.29 | 2.14 |
| 7 | 45.86 | 52.00 | 2.14 |
| 8 | 45.64 | 52.40 | 1.96 |
| 9 | 44.29 | 53.52 | 2.19 |
| 10 | 44.54 | 53.15 | 2.31 |
| 11 | 44.22 | 53.72 | 2.06 |
| 12 | 43.81 | 53.67 | 2.53 |
| 13 | 44.58 | 53.23 | 2.19 |

| |
|---|
| γ |
| β |
| Lam |

METHOD FOR MANUFACTURING A TITANIUM-ALUMINUM ALLOY PART

BACKGROUND

Technical Field

The present invention relates to the manufacture of a titanium-aluminum (TiAl) alloy in view of its use as a structural material for producing a part, for example in the aeronautics sector for the manufacture of turbine blades for airplane or helicopter engines, or else in the automobile field for manufacturing valves.

Description of the Related Art

One problem posed in this type of industry is associated with the quality of materials used, especially for manufacturing parts exposed to very high temperature and pressure constraints.

Since the 1980s, TiAl alloys have been subjected to extensive research efforts to replace the single crystal nickel-based superalloys used for more than fifty years in turbine blades. TiAl alloys have the advantage of being half as dense as superalloys. Their use improves engine efficiency, lightens structures, saves fuel and reduces sound and greenhouse gas emissions. Today most engine manufacturers have integrated TiAl alloy turbine blades into their latest airplane engines. To date, all of these blades have a GE type chemical composition (46 to 48% aluminum, 2% niobium and 2% chromium, the balance being titanium) and are developed by the casting route, followed by heat treatments.

Casting GE type alloys enables blades to be manufactured for low pressure stages of an airplane engine. A GE type alloy has a high creep performance due to the presence of a predominantly or totally lamellar microstructure. Consequently, the incorporation of more constrained and hotter engines into engine stages means the manufacture of blades made from higher performance materials, particularly more oxidation-resistant materials, hence the introduction of higher quantities of elements such as niobium and/or refractory elements such as tungsten. Given that these refractory-element doped alloys are characterized in casting by poor ductility resulting from high resistance, using such blades in other stages of an airplane engine is not currently possible.

Due to a relatively complex equilibrium diagram, TiAl alloy microstructures that are critical for the properties are highly dependent on the thermal history undergone by the alloy and on the development method used. For increasing heat treatment temperatures and for conventional compositions described by a binary diagram, biphase ($g+a_2$), duplex (g+lamellar) and lamellar microstructures are obtained. The $\gamma$ phase is a quadratic $L1_0$ structure, the $\alpha$ phase is a disordered hexagonal and the $\alpha_2$ phase is an ordered hexagonal $DO_{19}$ structure. The lamellar structure is obtained during cooling of $\alpha$ grains.

Solidification processes such as casting or directional solidification enable the formation of columnar structures formed of elongated and lamellar grains with interfaces perpendicular to the longitudinal axis of the grains. Research indicates that the most efficient microstructures are microstructures in which the crystallographic grains have a size of a few dozen microns and are formed either exclusively or in a high proportion of lamellar grains. It has also been demonstrated that a lamellar microstructure with small grains obtained by a succession of heat treatments has good mechanical strength and ductility on the order of 5%, which is rather exceptional.

One of the difficulties encountered with obtaining a lamellar microstructure results from the fact that the $\alpha$ transus of the equilibrium diagram must be crossed (about 1325-1350° C., depending on the chemical composition of the alloy) while any incursion into this $\alpha$ area causes grain enlargement, which very quickly exceeds a hundred microns.

Regarding the creep stability of TiAl alloys at operating temperatures (700-800° C.), it has been shown that diffusion plays an important role in the displacement of dislocations by climb mechanisms and therefore a too-high proportion of grain boundaries or interfaces is harmful to creep stability because these boundaries or interfaces facilitate diffusion by the presence of gaps.

Since the 1990s, numerous studies on TiAl alloys of varied chemical compositions, developed by diverse implementation processes, have been published. At times, several development routes (smelting, casting, forging, powder metallurgy or PM) have been applied to some of these grades (Microstructure and Deformation of Two-Phase $\gamma$-Titanium Aluminides, APPEL F, WAGNER R, Mar. Sci. Eng., R22, 5, 1998). Table 1 compares the mechanical properties of the alloys cited in this review. The figures characterize strength and ductility at room temperature. Creep stability is qualified for a temperature range of 700 to 750° C. In this table, the column YS indicates yield strength (in MPa) at 0.2% deformation, RM tensile strength (in MPa) and A is elongation at rupture of the material under consideration.

TABLE 1

| | Tensile Room Temperature | | | |
|---|---|---|---|---|
| Alloys | YS (MPa) | RM (MPa) | A (%) | Creep |
| GE - PM - Duplex | 400 | | 0.45 | poor |
| GE-Casting-quasi-lamellar | 420 | | 0.5 | average |
| TNB - Cast + extruded | 895 | 994 | 0.69 | excellent |
| TNB - PM + Rolling | 754 | 881 | 2.5 | excellent |
| ABB23-Casting | 480 | 565 | 0.3 | excellent |
| G4-Casting | 480 | 550 | 1.2 | excellent |
| Directional solidification | 545 | 590 | 25.5 | exceptional |

Following preliminary work on binary alloys only containing titanium and aluminum, the community concentrated its efforts on GE type grades characterized by aluminum contents between 46 and 48 atomic % and by an addition of 2% niobium and 2% chromium. Research has been undertaken on this type of GE alloy by comparing two powder casting and metallurgy routes that respectively possess textured quasi-lamellar and duplex microstructures. The first two lines of table 1 summarize the properties of these alloys. It is observed that the ductility of these two alloys is low and that only the alloy developed by casting has adequate creep stability.

Alloys containing niobium (called TNB: Ti-45Al-(5-10) Nb) were then developed, more specifically in combination with the forging method or for the manufacture of thin sheets. With solid materials, the best creep results have been obtained for extruded alloys containing carbon. For example the creep rate is $6 \cdot 10^{-9}$ $s^{-1}$ under 500 MPa at 700° C. but the ductility of these alloys is 0.69% on average, with samples brittle at 0.34% deformation (Strength Properties of a Precipitation Hardened High Niobium Containing Titanium Aluminide Alloy, PAUL J, OEHRING M, HOPPE R, APPEL F, Gamma Titanium Aluminides 2003, 403, TMS, 2003). In this last publication, the tensile curves for thirty-three samples were reported, which illustrates the strong dispersion on properties inherent to the casting route. Interesting properties have been measured on TNB alloy rolled sheets from powder metallurgy by the same group (line 4—table 1): ductility is 2.5% and the creep rate is $4.2 \cdot 10^{-8}\ s^{-1}$ under 225 MPa at 700° C. These good properties are connected to a microstructure formed of g grains of a small size (5 μm).

Research based on two ideas has concentrated on alloys containing heavy elements: β solidification that could reduce grain size and reduced mobility of high-temperature dislocations by interaction of these elements with the dislocations. This is the case with ABB type alloys (U.S. Pat. No. 5,286,443 and U.S. Pat. No. 5,207,982) and G4 alloys (FR-2 732 038). ABB type alloys contain 2 atomic % tungsten and less than 0.5% silicon and boron.

ABB family alloys of composition Ti-47Al-2W-0.5Si have been studied in detail. This composition has a fine microstructure formed of lamellar grains, plume structures and g regions and excellent creep stability but very limited ductility. G4 type alloys contain 1 atomic % tungsten, 1 atomic % rhenium and 0.2% silicon. These alloys present excellent creep performance, as well as reasonable ductility of 1.2% at 20° C. The strong interest of these G4 alloys comes from the fact that their mechanical properties are optimal in a simple structural condition without very high-temperature homogenization treatment, unlike ABB type alloys. It turns out that casting structures, of somewhat winding nature, especially with the interweaving of numerous crystal dendrites, markedly contributes to the gain in mechanical properties. A somewhat similar proportion of rhenium and tungsten is also recommended, given that during solidification, rhenium is emitted into the interdendritic regions while tungsten instead segregates within the dendrites.

Certain alloys present exceptional properties but they are obtained by complex methods that are difficult to industrialize at a competitive cost. Line 7 of table 1 gives the properties of alloys obtained by directional solidification: Their microstructure is formed of lamellar grains elongated along the direction of solidification and with interface planes parallel to the same direction. The alloy of composition Ti-46Al-1Mo-0.5Si has an elongation at rupture of more than 25% at room temperature and a creep strength of $3.5 \cdot 10^{-10}\ s^{-1}$ under 750° C. and 240 MPa.

Lastly, another powder metallurgy route has been the subject of recent work. A method called ARCAM consists of the melting of powder by electron beams, a technique that gives, like SPS (Spark Plasma Sintering), a complex form to the part. Tensile test results show ductility on the order of 1.2% and yield strength on the order of 350 MPa, for GE type alloys densified by this method. One disadvantage linked to this route is a loss of aluminum (typically 2 atomic % Al) during smelting as aluminum concentrations are very critical for the properties. Implementation of this method also requires a vacuum chamber, which leads to high manufacturing costs.

BRIEF SUMMARY

The present invention aims to mitigate the disadvantages of the prior art. In particular, the invention aims to provide means to make a part presenting interesting mechanical properties enabling, in particular, the needs of aeronautics engine manufacturers to be met by having, at room temperature, a yield strength of approximately 400 MPa at 0.2% and an elongation at rupture on the order of 1.5%, and creep at 700° C.-300 MPa and at 750° C.-200 MPa, and a time before rupture of at least 400 hours. Thus, the object of the present invention is to provide parts with excellent properties, particularly from the point of view of room temperature ductility and heat resistance.

In the present invention, "part" is understood to refer to any product obtained by the present invention intended to be subsequently used as a blank for a mechanical part, as a mechanical part (turbine blade, valve, etc.) or part of a mechanical part (valve head, etc.) or else several mechanical parts (production of several blades or valves or any assembly of mechanical parts, especially complex mechanical parts). Here a disk, block, bar or any other base element that can be used for machining a mechanical component are also all considered to be parts.

The method according to the invention also aims to obtain parts presenting a high level of homogeneity of microstructures and, consequently, excellent reproducibility of mechanical properties.

Advantageously, the present invention will provide a method characterized by a low cost and by a robustness of means enabling its implementation.

The method according to the invention will advantageously also offer a high manufacturing speed and will enable parts to be manufactured without subsequent heat treatment, thus allowing blade preforms to be manufactured directly, thereby limiting machining.

For this purpose the present invention proposes a method for manufacturing a metal alloy part (PF) by spark plasma sintering, comprising the simultaneous application of a uniaxial pressure and of an electric current to equipment containing a powder component material that has the following composition in atomic percentages:

- 42 to 49% aluminum,
- 0.05 to 1.5% boron,
- at least 0.2% of at least one element selected from tungsten, rhenium and zirconium
- optionally 0 to 5% of one or more elements selected from chromium, niobium, molybdenum, silicon and carbon,
- the balance being titanium and the total of the elements without aluminum and titanium being between 0.25 and 12%.

Therefore the present invention proposes combining, in a truly original way, a titanium and aluminum based alloy, presenting a specific chemical composition, with a spark plasma sintering (or SPS) manufacturing method. Surprisingly, the method above enables parts with mechanical characteristics largely responding to the requirements of aeronautics engine manufacturers to be obtained.

The chemical composition of the material used in the method according to the invention is based on relatively inexpensive elements, such as tungsten.

TiAl alloys conventionally manufactured by casting are much less efficient in terms of the ductility/creep stability compromise and microstructure reproducibility than alloys obtained by a method according to the present invention. In addition, this route (casting) requires heat treatments and greater machining of materials to be applied to the alloys than the SPS route.

Here, the utilization of the powder metallurgy (PM) route combined with the spark plasma sintering route enables microstructures for the alloys selected by the present invention to be refined and homogenized and enables them to be implemented at higher operating temperatures. The electric current can pass directly into the powder material and/or into the equipment and thereby increases the temperature of the material.

Other routes considered, such as forging and electron beam powder melting, have not for the time being resulted in the manufacture of blades and in the joint production of an alloy as high-performing as that obtained from the method according to the present invention. The metal alloy part (PF) obtained from the method according to the invention contains heavy elements in quantities of less than 5 atomic % and boron in very low quantities (0.05 to 1.5 atomic %), which results in a creep-resistant, small-grained lamellar microstructure. Another advantage of the present invention resides in the fact that systematically searching for low-aluminum grades to, for example, promote β solidification is unnecessary because the alloy obtained from the method contains boron for obtaining a fine microstructure with equiaxed grains. One original feature compared to existing alloys is thus to be able to offer an aluminum-rich grade that also is of interest regarding ductility and oxidation resistance.

The chemical composition-densification by Spark Plasma Sintering coupling according to the present invention enables an alloy presenting a particular microstructure with exceptional mechanical properties to be obtained. It is formed of small lamellar grains, surrounded by peripheral γ regions. The combination of this method with the chemical composition claimed enables a part with much higher qualities than those of parts in alloys from the prior art to be obtained. In fact, a part presenting the same chemical composition as that claimed but developed by the powder metallurgy (PM) route combined with the conventional hot isostatic pressing (HIP) method would not present exceptional properties, which confirms the original character obtained thanks to the method according to the invention.

The method thus defined according to the present invention limits grain enlargement, obtains a fine lamellar microstructure, has a g phase that is intrinsically resistant to heat and, at room temperature, has good mechanical property reproducibility as well as a very good compromise between room temperature ductility and high-temperature creep stability.

Preferably, the material used in the context of the method according to the invention comprises at least one of the following elements in the proportions defined below:

0.2 to 4% tungsten, 0.2 to 4% rhenium, 0.2 to 5% zirconium, 0 to 3% chromium, 0 to 5% niobium, 0 to 5% molybdenum, 0 to 2% silicon, 0 to 1% carbon.

In a particular embodiment, the material used in the context of the method according to the invention corresponds to the following composition in atomic percentages: 49.92% titanium, 48.00% aluminum, 2.00% tungsten, 0.08% boron.

Preferably, the method according to the present invention comprises the following steps:

Select a composition chosen from the compositions defined above for the present invention, Apply pressure greater than 30 MPa and progressively increase the temperature to a target between 1200 and 1400° C.

Maintain the target temperature for at least one minute.

Return the temperature and pressure to ambient conditions.

In one embodiment of the method according to the invention, pressure between 80 and 120 MPa is applied during step b). Preferably, the pressure progressively increases during step b) over a period of less than 5 minutes.

In another embodiment of the method according to the invention, still in step b), the temperature increases from 80 to 120° C./min.

Preferably, during step c), the temperature is held at the target for two minutes.

The method according to the present invention is used in a particularly advantageous manner to manufacture a turbine blade preform and/or a turbocharger turbine wheel and/or a valve (or at least a valve head) and/or a piston pin.

Other characteristics and advantages of the invention will appear upon reading the following description. The description is purely illustrative and should be read with reference to FIGS. 1 to 7 characterizing a method according to the present invention.

DETAILED DESCRIPTION

Here manufacturing a part in a titanium and aluminum based alloy by a method known by the name SPS (Spark Plasma Sintering, in French frittage flash) from a powder component material is proposed in an original way. The alloy utilized has the following composition in atomic percentages:

42 to 49% aluminum, 0.05 to 1.5% boron, at least 0.2% of at least one element selected from tungsten, rhenium and zirconium, optionally 0 to 5% of one or more elements selected from chromium, niobium, molybdenum, silicon and carbon, the balance being titanium and the total of the elements without aluminum and titanium being between 0.25 and 12%.

This material contains heavy elements in a quantity of less than 5 atomic % and boron in very low quantities (0.05 to 1.5%). Preferably, the material comprises, in addition to titanium, aluminum and boron, at least one of the following elements in the proportions defined below:

0.2 to 4% tungsten,
0.2 to 4% rhenium,
0.2 to 5% zirconium,
0 to 3% chromium,
0 to 5% niobium,
0 to 5% molybdenum,
0 to 2% silicon,
0 to 1% carbon.

Still more preferentially, it corresponds to the following composition $Ti_{49.92}Al_{48}W_2B_{0.08}$.

Figure 1:
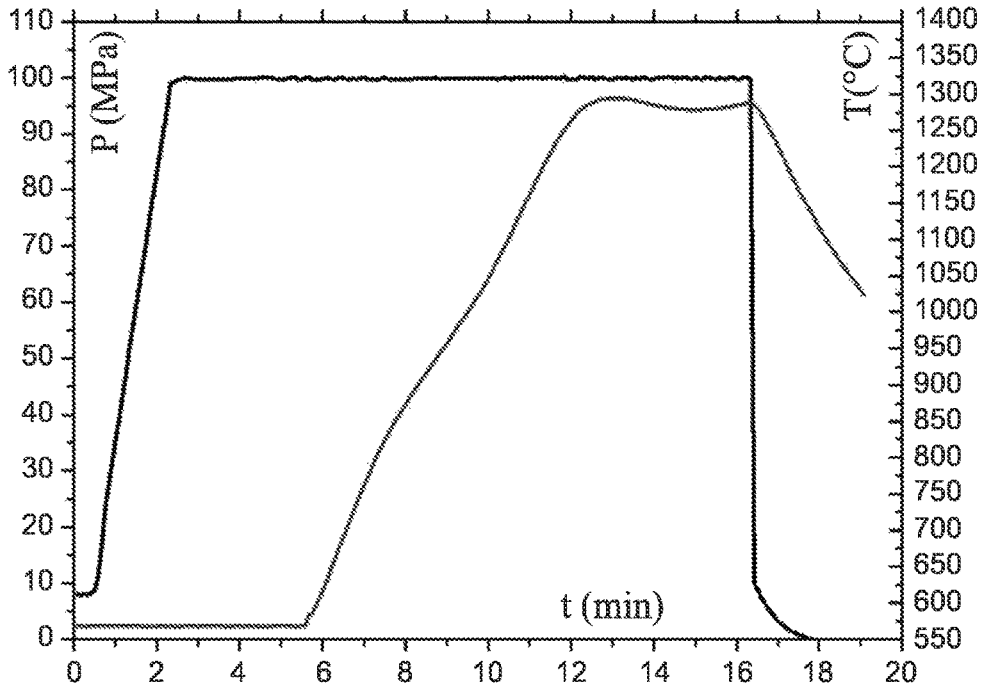
FIG. 1 illustrates an evolution of pressure and temperature measured in terms of time during an SPS cycle implemented according to the invention.

Alloys of small grained lamellar structures are thus obtained by a simple SPS cycle according to the present invention. The SPS cycle used in the context of the invention is based on the method described in international application WO 2012/131625, where a uniaxial pressure is applied directly or through force transmission parts, by means of at least two pistons (P1, P2) sliding towards each other inside a die, said pistons and/or said force transmission parts presenting bearing surfaces in contact with the component material and cooperating with each other to define the form of the part to be manufactured. More specifically, reference is made to the description of this international application (page 10, line 12 to page 12 line 4) relating to the device to be implemented to make a complex part as well as to FIGS. 3, 4 and 6 of this document. FIG. 1 of this prior international application illustrates a part that can be obtained with the device described.

The device presents the advantage of enabling the manufacture of metal parts with complex shapes. However, using a different device enabling the implementation of an SPS method to implement the present invention can also be contemplated.

An SPS method, for a part with simple or complex geometry, has never so far been used with a material corresponding to the composition as defined above. This combination of a manufacturing method with a specific alloy surprisingly produces a metal alloy part presenting exceptional mechanical properties, as illustrated below.

Using the device presented and claimed in document WO2012/131625 is proposed with an SPS method according to a cycle presented in FIG. 1. In this figure, it is noted that at time t=0, a pressure of 100 MPa is quickly applied to the alloy introduced in the device and a rise in temperature begins after the alloy is pressurized. The pressure rise lasts approximately 2 minutes. The temperature rise is achieved by passing an electric current into the corresponding device at a reference speed of approximately 100° C./min, except for the last three minutes before reaching target, when the reference speed is reduced to 25° C./min to take into account the thermal inertia of the assembly and avoid exceeding a reference temperature. The temperature rise can be obtained by direct passage of the current into the powder material or else by the passage of current into a die that exchanges heat with the powder material. After approximately 2 minutes of maintaining the target temperature (1355° C.), the pressure and heating are stopped. In less than 30 minutes, the densification test is terminated and the sample is available. It should be noted that FIG. 1 illustrates, in particular, measured temperatures which are lower than the core temperature of the material, but the temperature difference between the measured temperature and the temperature in the material is known because it can be calibrated.

Figure 2:
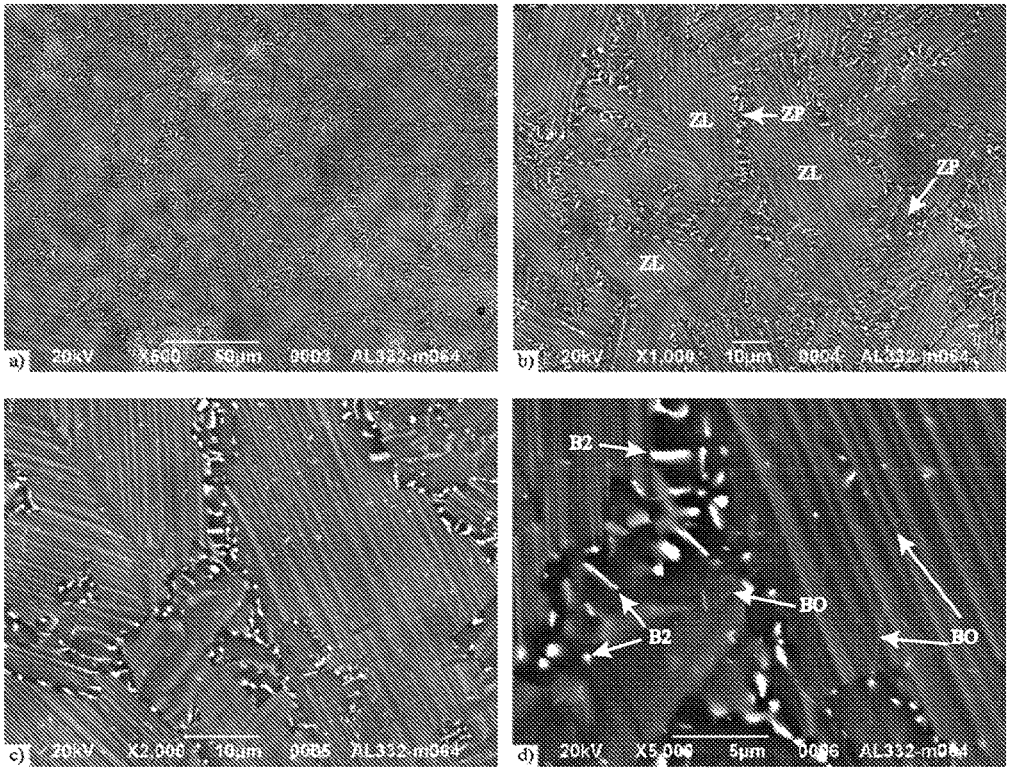
FIG. 2 illustrates images obtained by SEM (acronym for Scanning Electron Microscopy) of a microstructure of a part from the method according to the invention in different enlargements.

The alloy constituting the part obtained has a microstructure illustrated in FIG. 2, which presents scanning electron microscopy images in different enlargements. It is formed of lamellar grains surrounded by peripheral g phase regions containing B2 phase precipitates, with a strong white contrast. The lamellar grains have an average size of 30 μm. The peripheral g regions are of elongated shape (a few microns). In the lamellar regions, low-contrast bands are observed (noted BO in FIG. 2*d*), which are borides.

Figure 3:
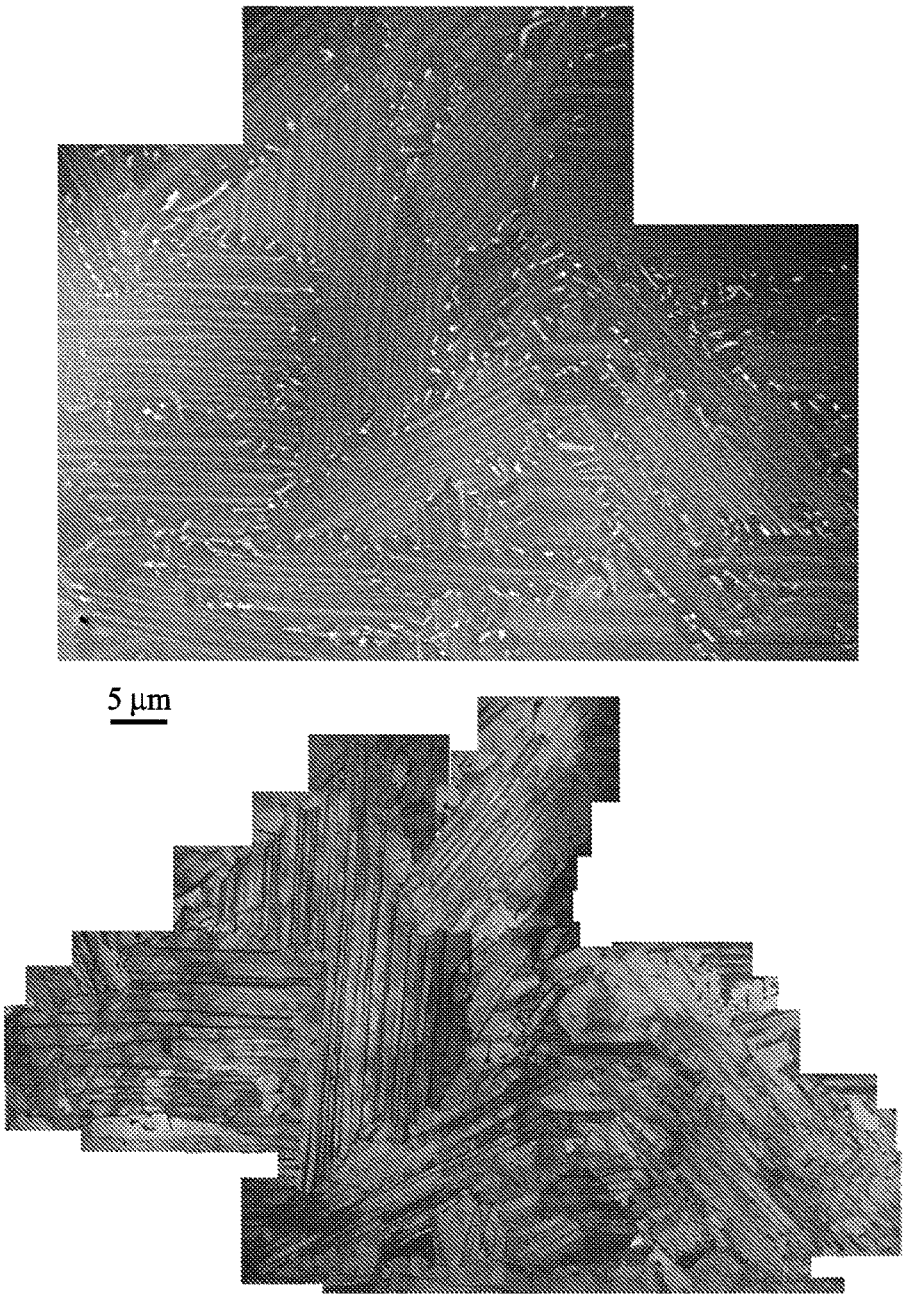
FIG. 3 illustrates a large region of a microstructure of a part from the method according to the invention studied in SEM and TEM (acronym for Transmission Electron Microscopy)
Figure 4:
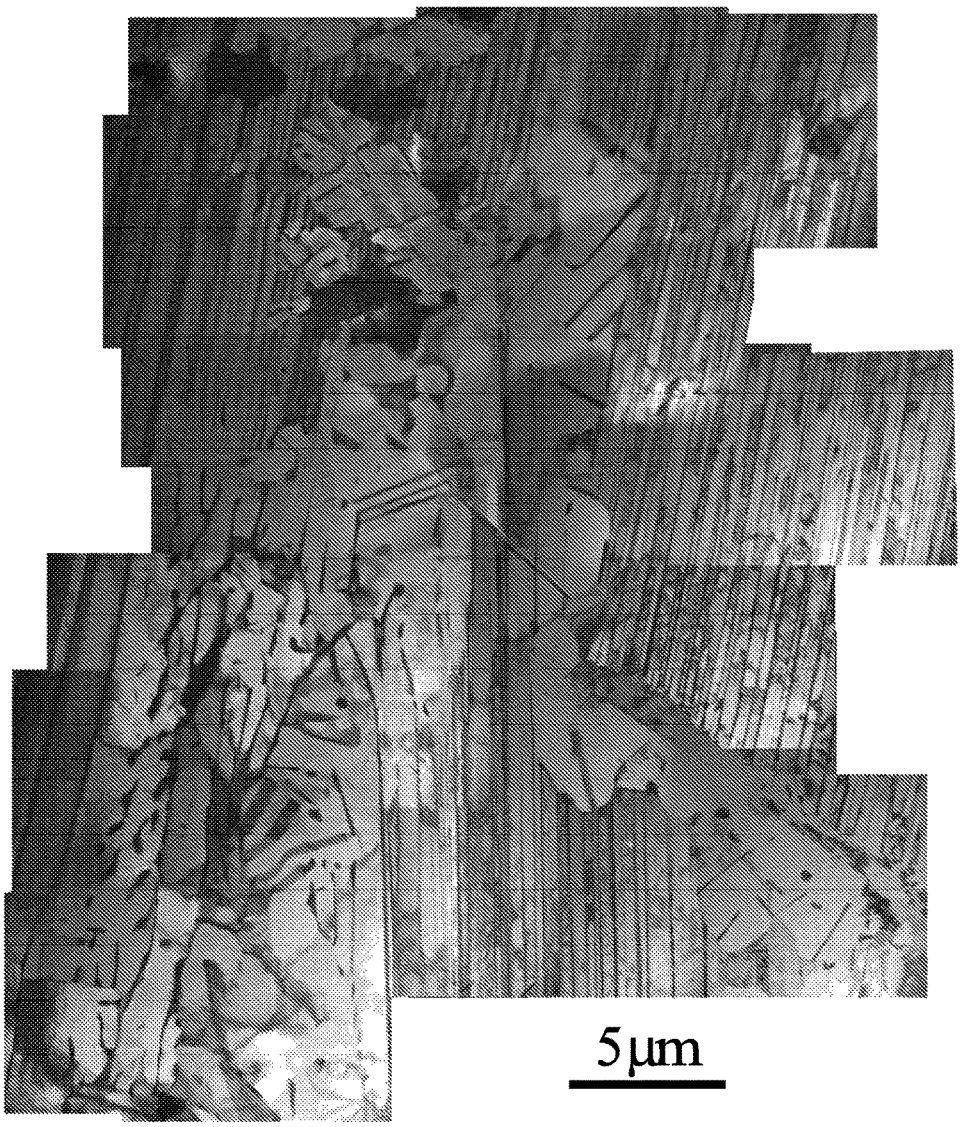
FIG. 4 illustrates a peripheral g region containing B2-phase precipitates between lamellar grains observed by TEM of the microstructure of a part from the method according to the invention.

FIG. 3 presents a same region observed by scanning microscope and by transmission electron microscope. In general, the lamellar regions have a conventional appearance: They are formed of lamellae with an average width of 0.15 μm and are separated by very straight interfaces. The $\alpha_2$ phase proportion in these lamellar regions is approximately 10%. A peripheral region is shown in detail in FIG. 4, where extension of the g phase is observed in the boundaries between lamellar grains.

Figure 5:
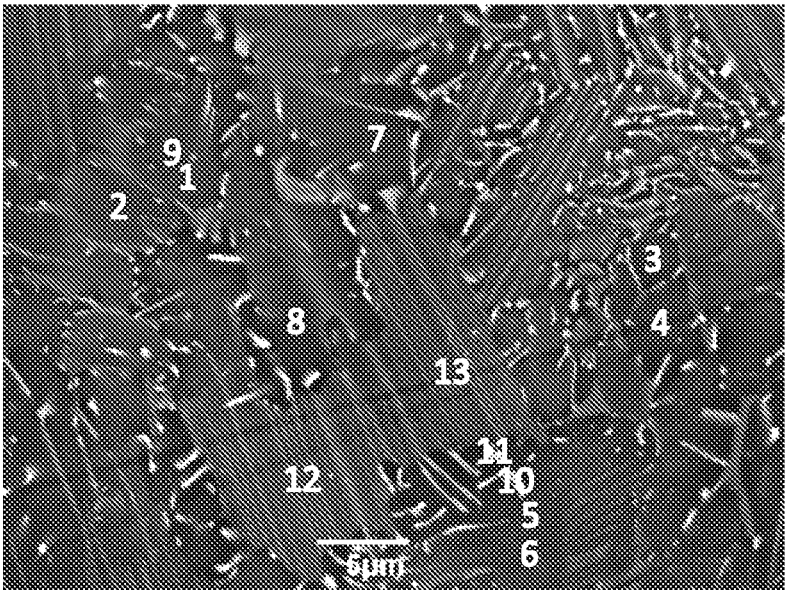
FIG. 5 illustrates local chemical analyses by EDS-SEM (for Energy Dispersive X-Ray Spectroscopy-Scanning Electron Microscopy) of a part from the method according to the invention.

FIG. 5 shows local analyses of the chemical composition by EDS-SEM. Tungsten is distributed fairly evenly in all phases, which is rather unexpected because the B2 and $\alpha_2$ phases should accept larger proportions.

The formation mechanism of this microstructure is not completely clear because the equilibrium diagram corresponding to this composition is not completely known. Work is in progress on this formation mechanism. However, it seems that the rise in temperature to 1355° C. enables the α transus to be crossed. However, either because they don't exist for this α single phase region, or because the transformation kinetics are too slow, it is probable that β regions in the periphery of α grains remain at 1355° C. The limitation of α grain enlargement is therefore due not only to boron but perhaps also to the presence of this residual phase. During cooling, two transformations occur: Lamellar transformation facilitated by the presence of boride and the transformation of β peripheral regions into g+B2.

Figure 6:
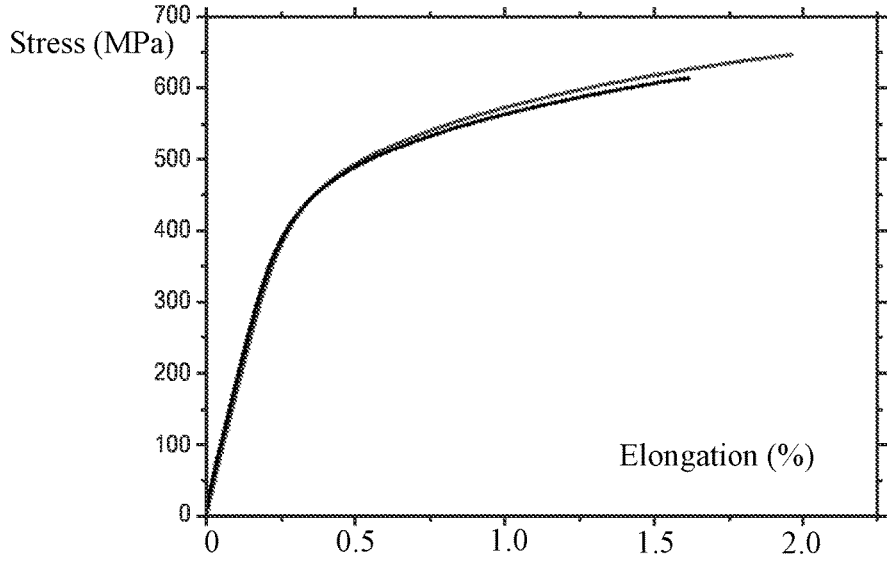
FIG. 6 illustrates tensile curves at ambient temperature obtained in two samples of the alloy obtained by the method according to the invention.
Figure 7:
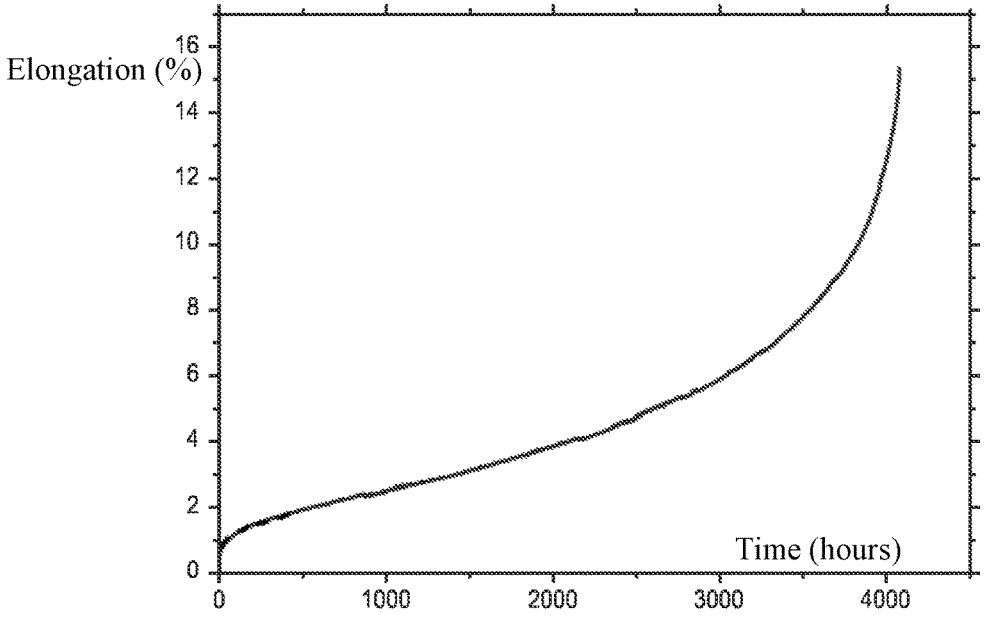
FIG. 7 illustrates creep curves obtained at 700° C. under 300 MPa in two samples of the alloy obtained by the method according to the invention.

FIGS. 6 and 7 illustrate the exceptional mechanical properties of this alloy by showing the tensile curves at room temperature and the creep curves at 700° C. under 300 MPa. In each case, two curves obtained for samples extracted from different SPS disks are represented. The second creep test was interrupted at 1.5% to be able to study the deformation microstructure by electron microscopy and attempt to explain the good creep behavior. The overlapping curves illustrate the high reproducibility of mechanical properties of samples obtained by the SPS method. The tensile curve at room temperature gives: An elongation at rupture of 1.6%, a yield strength of 496 MPa and a tensile strength of 646 MPa. In creep at 700° C. under 300 MPa, the secondary rate is $3.7 \cdot 10^{-9}$ $s^{-1}$ and the time before rupture is 4076 hours, which is exceptional. In addition, the creep rate under 750° C. was measured. It is $2.3 \cdot 10^{-9}$ $s^{-1}$ under 120 MPa and $5.8 \cdot 10^{-9}$ $s^{-1}$ under 200 MPa, values which confirm the excellent creep stability of parts obtained according to the present invention.

The tables below summarize the tensile and creep results obtained thanks to the present invention with the composition $Ti_{49.92}Al_{48}W_2B_{0.08}$.

Tensile:

| T (° C.) | YS (MPa) | Rm (MPa) | A (%) |
|---|---|---|---|
| 20 | 496 | 646 | 1.6 |
| 700 | 432 | 614 | 2.7 |
| 800 | 420 | 568 | 17.8 |

-continued

| T (° C.) | YS (MPa) | Rm (MPa) | A (%) |
|---|---|---|---|
| 900 | 348 | 416 | 14.37 |
| 950 | 296 | 356 | 11.95 |

Creep:

| Secondary rate ($s^{-1}$) | Lifespan (hours) | A = 1% (hours) |
|---|---|---|
| 700° C./300 MPa: $3.7 \cdot 10^{-9}$ | 4076 | 180 |
| 750° C./200 MPa: $5.8 \cdot 10^{-9}$ | 3135 | 300 |
| 750° C./120 MPa: $2.3 \cdot 10^{-9}$ | 8734 = 2.48% | 1500 |

These excellent results enable the person skilled in the art to better understand the interest of the present invention for high-temperature applications.

The ductility obtained can be explained by: i) the presence of peripheral g regions that accept a substantial amount of deformation, ii) the characteristics of lamellar regions (rather large lamellae sizes) that are also deformable and iii) the reduced size of lamellar grains that limits the formation of piles generating internal stresses leading to rupture. The exceptional creep stability can be explained by the strength of the lamellar structure and the good dispersion of tungsten in the g die that is deformed. It appears that the characteristic dimensions of the microstructure obtained following the method according to the invention, i.e., grain size and lamella width, are close to ideal so that dislocations are not too easily displaced by involving diffusion and sufficient grain interfaces and boundaries exist to impede the movement of dislocations.

Following the method according to the invention, a metal alloy part can be manufactured. This part would present characteristics going beyond the characteristics corresponding to the needs mentioned above for airplane engine turbine blades (yield strength of approximately 400 MPa at 0.2% at room temperature and an elongation at rupture on the order of 1.5%, and creep at 700° C.-300 MPa and at 750° C.-200 MPa, a time before rupture of at least 400 hours) and would even easily meet all of the required specifications.

Of course, the present invention is not limited to the preferred form of embodiment described above by way of non-limiting example and to the embodiments mentioned; it also relates to any embodiment within the reach of the person skilled in the art in the context of the following claims.

The invention claimed is:

1. A method, comprising:

manufacturing a metal alloy part by spark plasma sintering, the manufacturing including:

simultaneously applying a uniaxial pressure and of an electric current to equipment containing a powder component material that has the following composition in atomic percentages:

42 to 49% aluminum, 0.05 to 1.5% boron, at least 0.2% of at least one element selected from tungsten, rhenium and zirconium, 0 to 5% of one or more elements selected from chromium, niobium, molybdenum, silicon and carbon, the balance being titanium and the total of the elements without aluminum and titanium being between 0.25 and 12%.

2. The method according to claim 1, wherein the material comprises at least one of the following elements in the proportions defined below:

0.2 to 4% tungsten, 0.2 to 4% rhenium, 0.2 to 5% zirconium, 0 to 3% chromium, 0 to 5% niobium, 0 to 5% molybdenum, 0 to 2% silicon, 0 to 1% carbon.

3. The method according to claim 1, wherein the material has the following composition in atomic percentages: 49.92% titanium, 48.00% aluminum, 2.00% tungsten, 0.08% boron.

4. The method according to claim 1, comprising:

a) selecting the composition defined in claim 1, b) applying pressure greater than 30 MPa and progressively increasing a temperature to a target temperature between 1200 and 1400° C., c) maintaining the target temperature for at least one minute, d) returning the temperature and pressure to ambient conditions.

5. The method according to claim 4, wherein the pressure applied during step b) is between 80 and 120 MPa.

6. The method according to claim 4, wherein the pressure progressively increases over a period of less than 5 minutes during step b).

7. The method according to claim 4, wherein increasing the temperature during step b) includes increasing the temperature from 80 to 120° C./min except for the last three minutes before reaching the target temperature, when the rate is reduced between 10 and 40° C./min.

8. The method according to claim 4, wherein during step c), the temperature is maintained at the target temperature for two minutes.

9. The method according to claim 1, wherein the metal alloy part is a turbine blade.

10. The method according to claim 1, wherein the metal alloy part is an internal combustion engine valve.

11. The method according to claim 1, wherein the metal alloy part is a turbocharger turbine wheel.

12. The method according to claim 1, wherein the metal alloy part is a piston pin.

* * * * *